US010822878B2

(12) United States Patent
Difoggio et al.

(10) Patent No.: US 10,822,878 B2
(45) Date of Patent: Nov. 3, 2020

(54) DIRECTIONAL DRILLING CONTROL SYSTEM AND METHODS

(71) Applicants: Rocco Difoggio, Houston, TX (US); Hans-Martin Maurer, Houston, TX (US); Leonty Tabarovsky, Cypress, TX (US)

(72) Inventors: Rocco Difoggio, Houston, TX (US); Hans-Martin Maurer, Houston, TX (US); Leonty Tabarovsky, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 148 days.

(21) Appl. No.: 15/136,362

(22) Filed: Apr. 22, 2016

(65) Prior Publication Data

US 2017/0306743 A1 Oct. 26, 2017

(51) Int. Cl.

| | |
|---|---|
| ***E21B 44/02*** | (2006.01) |
| ***E21B 7/04*** | (2006.01) |
| ***E21B 7/06*** | (2006.01) |

(52) U.S. Cl.

CPC ..... *E21B 7/067* (2013.01)

(58) Field of Classification Search

CPC ..... E21B 44/02; E21B 7/04; E21B 47/024; E21B 47/026

See application file for complete search history.

(56) References Cited

U.S. PATENT DOCUMENTS

| | | | |
|---|---|---|---|
| 5,230,386 | A | 7/1993 | Wu |
| 6,594,584 | B1 | 7/2003 | Omeragic |
| 7,697,141 | B2 | 4/2010 | Jones et al. |
| 8,237,920 | B2 | 8/2012 | Jones et al. |

(Continued)

FOREIGN PATENT DOCUMENTS

WO 0242605 A1 5/2002

OTHER PUBLICATIONS

Aalto University. ""D-Wave's Approach to Quantum Computing: Past, Present, and Future"—Dr. Colin P. Williams, 22.4.15." Online video clip. YouTube. https://www.youtube.com/watch?v=Yy93LMGQbpo, Published on May 28, 2015.

(Continued)

*Primary Examiner* — David J Bagnell
*Assistant Examiner* — Yanick A Akaragwe
(74) *Attorney, Agent, or Firm* — Cantor Colburn LLP

(57) ABSTRACT

A method for forming a wellbore in an earth formation includes positioning a drill string in a wellbore; the drill string including a bottom hole assembly (BHA) that includes a steering unit, one or more sensors responsive to one or more formation properties, and one or more sensors responsive to the current orientation of the BHA in a wellbore. The method also includes receiving information from the BHA related to the formation properties and information related to a current orientation of the BHA in the wellbore and processing the information using computing device that is either a programmable optical computing device or a quantum computing device. The computing device calculates the position of formation features with respect to current wellbore position in real time and compare the current position to a prescribed path.

11 Claims, 4 Drawing Sheets

(56) References Cited

U.S. PATENT DOCUMENTS

| | | | | |
|---|---|---|---|---|
| 8,525,995 | B2 | 9/2013 | Jones et al. | |
| 8,610,895 | B1 | 12/2013 | Irani et al. | |
| 8,817,264 | B2 | 8/2014 | Irani et al. | |
| 8,947,666 | B2 | 2/2015 | Jones et al. | |
| 2004/0216921 | A1 | 11/2004 | Krueger | |
| 2014/0151121 | A1 | 6/2014 | Boone et al. | |
| 2015/0369951 | A1 | 12/2015 | San Martin et al. | |
| 2016/0024847 | A1* | 1/2016 | Benson | E21B 7/06 175/24 |
| 2016/0102510 | A1* | 4/2016 | Mitchell | E21B 47/102 175/24 |
| 2017/0045800 | A1* | 2/2017 | Brandenburg | G02F 1/092 |
| 2018/0031729 | A1* | 2/2018 | Maguire-Boyle | G01V 9/00 |

OTHER PUBLICATIONS

Caulfield, et al. "Why future supercomputing requires optics" commentary, Nature Photonics | vol. 4 | May 2010 www.nature.com/naturephotonics, pp. 261-263.

Craig Gidney "What Quantum Computers Do Faster, with Caveats" Twisted Oak Harvard University, [online]; [retrieves on Dec. 17, 2017]; retrieved from the Internet Harvard University, [online]; [retrieved on Jun. 11, 2008]; retrieved from the Internethttp://adsabs.harvard.edu/abs/2007APS..MARN17003H 6 pages.

D-Wave-Two-System, [online]; The D-Wave 2000Q™ System, The most advanced quantum computer in the world [retrieved on Dec. 14, 2017]; retrieved from the Internet https://www.dwavesys.com/d-wave-two-system, 9 pages.

Emily Patsy "Total Triples Power of Supercomputer in Search for Exploration Savings" [online]; [retrieved on Dec. 17, 2017]; retrieved from the Internet https://www.epmag.com/total-triples-power-supercomputer-search-exploration-savings-843576 2 pages.

Ghosh, et al. "Trinary arithmetic and logic unit(TALU)using savart plate and spatial light modulator (SLM) suitable for optical computation in multivalued logic", Optics & Laser Technology 44 (2012) pp. 1583-1592.

History of supercomputing (From Wikipedia, the free encyclopedia) [online]; [retrieved on Dec. 14, 2017]; retrieved from the Internet https://en.wikipedia.org/wiki/History_of_supercomputing 4 pages.

Hwang, et al. "Optical multiplication and division using modified-signed-digit symbolic substitution" / Optical Engineering / Apr. 1989 / vol. 28 No. 4, pp. 364-372.

IBM Q, [online]; [retrieved on Dec. 14, 2017]; retrieved from the Internet https://www.research.ibm.com/ibm-q/. 6 pages.

Joel Carpenter . "110×110 Optical Mode Transfer Matrix Inversion (ECOC 2013 paper Th 1 C 1)" Online video clip. YouTube. https://www.youtube.com/watch?v=7yNRR8xUBdA, Published on Sep 26, 2013.

Joshi "Cost/Benefits of Horizontal Wells" SPE 83621 SPE Western Regional/AAPG Pacific Section Joint Meeting held in Long Beach, California, U.S.A., May 19-24, 2003. 9 Pages.

Luke Hurst "Affordable, Light-Speed Supercomputer One Step Closer" Apr. 27, 2015 at 11:47 AM Newsweek, [online]; [retrieved on Dec. 14, 2017]; retrieved from the Internet http://www.newsweek.com/lightspeed-number-cruncher-take-supercomputing-next-level-325520, 7 pages.

Optalysys, [online]; [retrieved on Dec. 14, 2017]; retrieved from the Internet hhttps://www.optalysys.com/news/2017/10110/light-speed-computing-now-only-months-away, dated Aug. 1, 2014 (http://optalysys.com/light-speed-computing-now-only-months-away/) 4 pages.

Our quantum computer is 100 million times faster than a conventional system, [online]; [* by Joel Hruska on Dec. 9, 2015 at 1:37 pm]; [retrieved on Dec. 14, 2017]; retrieved from the Internet http://www.extremetech.com/extreme/219160-googles-quantum-computer-is-100-million-times-faster-than-a-conventional-system, 8 pages.

Siegel, Bakken 5-Year Drilling & Completion Trends [online]; [retrieved on Dec. 14, 2017]; retrieved from the Internet http://www.dtcenergygroup.com/bakken-5-year-drilling-completion-trends/ 11 pages.

Silva, et al. "Performing Mathematical Operations with Metamaterials" Jan. 10, 2014 vol. 343 Science pp. 160-163.

Snieder, et al. "Inverse Problems in Geophysics" Dept. of Geophysics, Utrecht University, Reprinted from "Wavefield Inversion", Ed. A. Wirgin, Springer Verlag, New York, p. 119-190, 1999.

Song, et al. "Design and implementation of the one-step MSD adder of optical computer" Mar. 1, 2012 / vol. 51, No. 7 / Applied Optics pp. 917-926.

Wang, "Optalysys completes 320 gigaFLOP optical computer prototype, targets 9 petaFLOP product in 2017 and 17 exaFLOPS machine by 2020", [online]; May 2, 2015 ;[retrieved on Dec. 14, 2017]; retrieved from the Internet https://www.nextbigfuture.com/2015/05/optalysys-completes-320-gigaflop.html, 9 pages.

Wu, et al. "Computing matrix inversion with optical networks" Jan. 13, 2014 | vol. 22, No. 1 | DOI:10.1364/OE.22.000295 | Optics Express, pp. 295-304.

Notification of Transmittal of the International Preliminary Report on Patentability of the International Searching Authority, or the Declaration; PCT/US2017/028766; dated Oct. 23, 2018, 12 pages.

Notification of Transmittal of the International Search Report of the International Searching Authority, or the Declaration; PCT/US2017/028766; dated Jul. 28, 2017, 4 pages.

Notification of Transmittal of the Written opinion of the International Searching Authority, or the Declaration; PCT/US2017/028766; dated Jul. 28, 2017, 11 pages.

* cited by examiner

DIRECTIONAL DRILLING CONTROL SYSTEM AND METHODS

BACKGROUND OF THE DISCLOSURE

This disclosure relates generally to subterranean drilling and, more particularly, to controlling directional drilling of wellbores and computing devices used in such drilling.

To obtain hydrocarbons such as oil and gas, boreholes or wellbores are drilled by rotating a drill bit attached to the bottom of a drilling assembly (also referred to herein as a "Bottom Hole Assembly" or "BHA"). The drilling assembly is attached to the bottom of a tubing, which is usually either a jointed rigid pipe or a relatively flexible spoolable tubing commonly referred to in the art as "coiled tubing." The string, which includes the tubing and the drilling assembly, is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated and horizontal wellbores to more fully exploit hydrocarbon reservoirs. Such boreholes can have relatively complex well profiles. To drill such complex boreholes, some drilling assemblies utilize a plurality of independently operable pads to apply force on the wellbore wall during drilling of the wellbore to maintain the drill bit along a prescribed path and to alter the drilling direction. The prescribed path may be predefined as part of a so-called well model. This model includes information about the location of a "pay-zone" from which fluids (such as crude oil or other hydrocarbons or water) may be extracted. The longer the actual wellbore stays within the pay zone may improve the yield of a particular wellbore. Improving the actual to the prescribed paths would, thus, be well received in the industry.

SUMMARY OF THE DISCLOSURE

In aspects, the present disclosure provides a method for forming a wellbore in an earth formation. In this aspect, the method includes positioning a drill string in a wellbore; the drill string including a bottom hole assembly (BHA) that includes a steering unit, one or more sensors responsive to one or more formation properties, and one or more sensors responsive to the current orientation of the BHA in a wellbore. The method also includes receiving information from the BHA related to the formation properties and information related to a current orientation of the BHA in the wellbore; processing the information using a programmable optical computing device, the programmable optical computing device calculating the position of formation features with respect to current wellbore position in real time (real time meaning concurrent with the well drilling progress); comparing the current position to a prescribed path; and causing the steering unit to change a course of the BHA during a drilling operation based on the comparison.

In one aspect, a system of drilling a wellbore in an earth formation, is provided and includes a drill string including a bottom hole assemble (BHA) that includes a steering unit, a high speed computing device that is either a programmable optical computing device or a quantum computing device, and a communication network coupling the BHA to the high speed computing device. In this system, the high speed computing device, in operation, calculates current wellbore position with respect to formation features, using information received form the BHA and compares that position to a prescribed path and provides information that causes the steering unit to change a course of the BHA during a drilling operation based on the comparison.

In another aspect, a method for forming a wellbore in an earth formation includes: positioning a drill string including a bottom hole assemble (BHA) that includes a steering unit, one or more sensors responsive to one or more formation properties, and one or more sensors responsive to the current orientation of the BHA in a wellbore; receiving information from the BHA related to the formation properties and information related to a current orientation of the BHA in the wellbore at a quantum computing device; processing the information using a quantum computing device, the quantum computing device calculating the position of formation features with respect to current wellbore position in real time; comparing the current position to a prescribed path; and causing the steering unit to change a course of the BHA during a drilling operation based on the comparison.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1A:
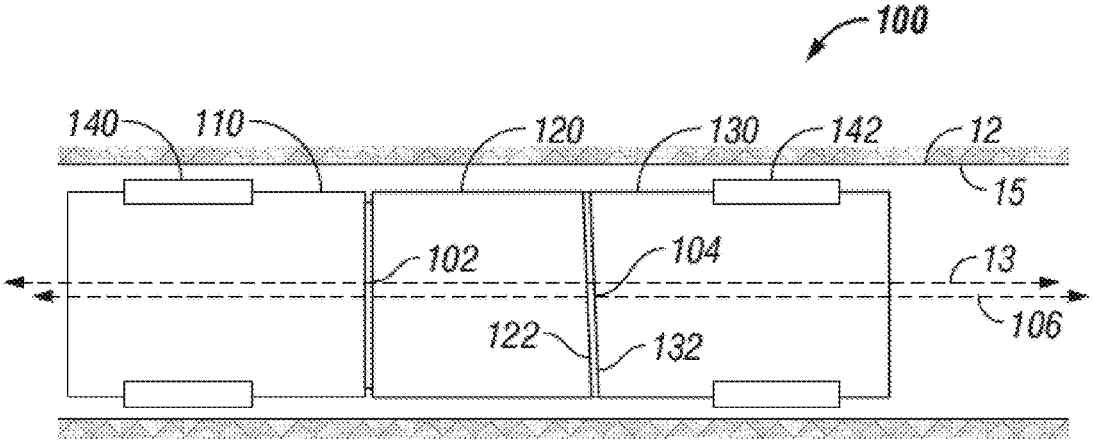
FIGS. 1A-C schematically illustrate an operation of a steering device that may be used to drill a horizontal or other directional wellbore.

The present disclosure relates to systems and methods for directional drilling of wellbores. The systems employ an optical computing device to transform measurement data received while drilling into information that may improve geosteering of the drillstring. Such a system may allow for the creating, in real time, of more realistic two and three dimensional formation models so as to improve geosteering when drilling substantially horizontal wells in order to keep a well more centered within a pay zone.

An optical computing device, as the term is used herein refers to device that may utilize photons, rather an electrical energy, to perform calculations. An example of an optical computing device includes a device that utilizes a laser to transmit light through a liquid crystal grid. By selectively applying electricity to each pixel of the grid, the light passing through it can be affected such that many calculations (e.g., multiplication, addition, etc.) may be carried out in parallel. After the laser has passed through this grid, the beam is picked up by a receiver and from the beam's diffraction and Fourier optics, matrix multiplication and Fourier transforms can be combined to perform complex calculations. Such a programmable optical computing device differs from a device that consists of a photodetector and a multiple-color optical filter whose transmission coefficients at each color are fixed upon fabrication (nonprogrammable) and are chosen to mimic chemometric regression coefficients for predicting properties of a fluid when light passes through both the filter and a known thickness of fluid before striking the photodetector. In that manner, the optical computing devices claimed herein may also be referred to as programmable optical computing devices.

In another embodiment, a quantum computing device is used instead of an optical computing device. A quantum computer maintains a sequence of qubits. A single qubit can represent a one, a zero, or any quantum superposition of those two qubit states; a pair of qubits can be in any quantum superposition of 4 states, and three qubits in any superposition of 8 states. In general, a quantum computer with nqubits can be in an arbitrary superposition of up to $2^n$ different states simultaneously (this compares to a normal computer that can only be in one of these $2^n$ states at any one time). Quantum computers are especially well suited to rapidly finding global minima among many local minima in a minimization process such as petrophysical inversion of measurements recorded in wells for generating an earth model of the properties and boundaries of the layers of the earth penetrated by the well bore. Because a quantum computer must be operated near absolute zero temperature, under ultrahigh vacuum, and zero magnetic field, most likely well log data would be sent to it for petrophysical inversion processing rather than having a quantum computer at well site.

The industry currently uses 1.5-D models (a name for 1-d models that are continuously updated with each increment in well depth) because of time constraints because 2d and 3d models would take prohibitively long to process with current computers and could not be done in real time. In particular, to do a petrophysical inversion of a 10 m drilling interval (e.g., to form an image of the earth's layers) with a 1.5d model takes about 2 minutes with a current 70 gigaflop computing device and entails ~100 iterations. One 2D iteration takes ~10 min, so a 2D inversion would take more than 100*(1/6)=16 h, much slower than the drilling progress. This information would come too late to be useful. 3D inversion would be at least another order of magnitude slower. In order to provide the results in a timely manner, the computer needs to be at least 500 times faster than current conventional ones. Use of the optical and quantum computing devices may alleviate this problem due to the fact that they may operate significantly faster than currently computers. At present, at least one optical computing device has been reported to operate at 320 GigaFlops. This would allow for the same inversion to take 0.4 minutes. Future devices are believed to be able to run at 9 petaflops which would further reduce the time to 1 milliseconds and their speed may reach 17 exaflops within the next four years, which would make them more than 500 times faster than the fastest current supercomputer. Optical computers are small enough to be placed upon a desktop and they can be plugged into ordinary wall power, which is unlike the current fastest supercomputer that uses 24 Megawatts of power and occupies 720 square meters of floor space.

Geosteering presents unique challenges and demands on real time processing. With an offshore drilling rig costing $1 to $2 million dollars per day ($42 to $83 thousand per hour), it is too expensive to stop drilling for 15 minutes to get an inversion answer for the next best direction in which to steer the bit. Drilling simply proceeds continuously. However, the consequences of not stopping drilling before getting the next drill bit heading are also expensive because at current drilling rates of about 1 foot per minute, if one is drilling in the center of a thin pay zone of 10 feet, the bit can simply wander outside of the pay zone if it takes 5 minutes to do the petrophysical inversion to get the next drill bit heading. Every time the bit wanders outside of the pay zone or wanders too close to the edge of the pay zone, it creates lost oil production for the entire life of the well which can add up to many millions of dollars of lost revenue. Despite this long unmet need for faster and more realistic real time petrophysical inversions for geosteering, no published reports are known for addressing this real-time need with a very dramatic increase in processing speed that could also permit the use of more realistic 2d and 3d models. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Figure 1B:
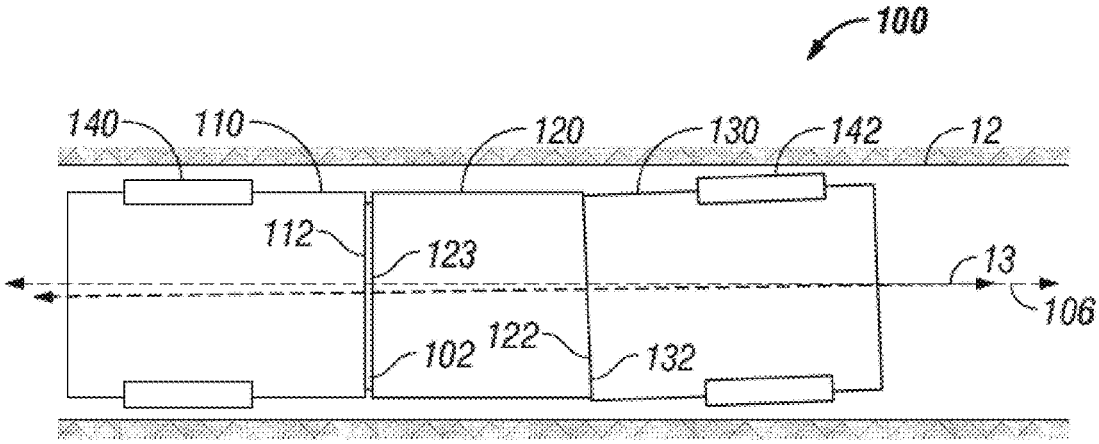
Figure 1C:
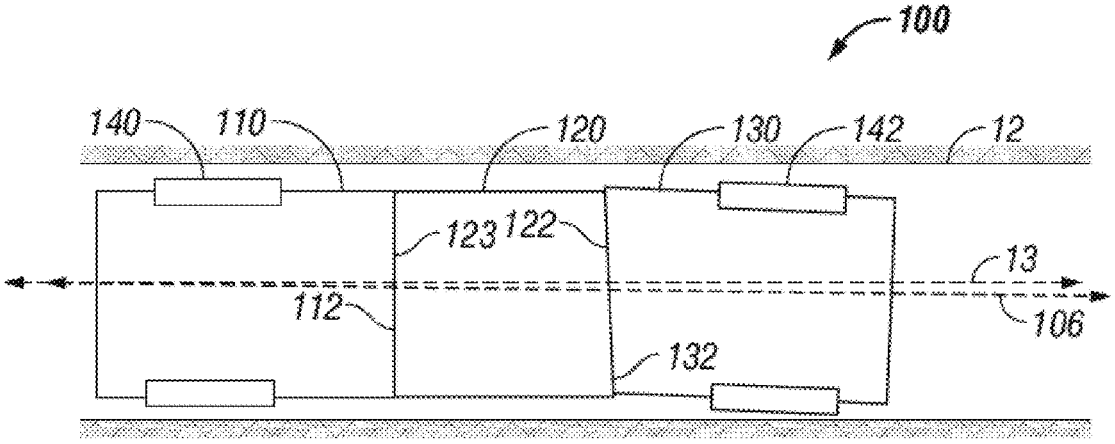

Referring now to FIGS. 1A-1C, there is schematically illustrated a steering unit 100 that may be used to cause a drill string to follow a particular, path. The steering unit 100 points a drill bit in a selected drilling direction by bending a section of the steering unit 100. The bend, which may be on the order of a one degree to a ten or more degree angle relative to a long axis 13 of a wellbore, can be rotated as needed to obtain a desired direction according to a selected reference frame or orientation (e.g., azimuthal direction, gravity tool face, etc.). The steering unit 100 may include a first or upper section 110, a second or middle section 120 and a third or lower section 130. The upper section 110 may include adjustable pads 140 that lock the upper section 110 into engagement with a wall 15 of the wellbore 12. The lower section 130 may also include pads 142. The pads 140, 142 may be fixed or adjustable.

A pivot bearing 102 separates the upper section 110 from the middle section 120 and a pivot bearing 104 separates the middle section 120 from the lower section 130. Each pivot bearing 102, 104 allows their respective adjacent sections to selectively rotate relative to one another. The pivot bearings 102, 104 may include internal devices that may allow such selective interlocking. The pivot bearing 102 allows relative rotation between the upper section 110 and the middle section 120, which controls the direction of drilling by controlling the direction (e.g., azimuth, inclination, gravity) in which the drill bit (not shown) is pointing. The pivot bearings 102, 104 may also be used to compensate for undesirable sleeve rotation due to friction. The pivot bearing 104 allows relative rotation between the middle section 120 and the lower section 130, which controls the magnitude of tilt or angular bend in the steering device 100.

Referring to FIG. 1A, the steering device 100 is shown in a "straight ahead" drilling mode. The middle section 120 and the lower section 130 have end faces 122 and 132 respectively that incorporate a tilt of the same angle. The tilt is relative to a plane perpendicular to the axial tool line 106. As shown, the end faces 122 and 132 have the slope of their respective tilts in the same direction, which has the effect of canceling their relative tilts. Thus, the axial centerline 106 of the steering device 100 is generally parallel with a centerline 13 of the wellbore 12.

Referring to FIG. 1B, the steering device 100 is shown in a directional drilling mode of operation. Upper section 110 and middle section 120 have end faces 112 and 123 which are perpendicular to the axial tool line 106, thereby enabling relative rotation of the upper section 110 and middle section 120 without affecting a magnitude of the bend angle. As shown, with respect to middle section 120 and lower section 130, end faces 122 and 132 have their direction of tilt aligned to maximize a tilt or bend angle caused in the steering device 100. That is, the end faces 122 and 132 have the slope of their respective tilts in opposite directions, which has the effect of compounding their relative tilts. This may be achieved by rotating the middle section 120 one-hundred eighty degrees relative to the upper section 110. Thus, the axial centerline 106 of the steering device 100 is generally angularly offset with the centerline 13 of the wellbore 12 and the drilling direction will generally follow the axial centerline 106, which will change the trajectory of the wellbore 12. In some embodiments, the amount of bend angle to be applied to the steering device 100 may be fixed. In other embodiments, the bend angle may be adjustable. That is, an offset between zero and one hundred eighty degrees will produce a proportionately smaller tilt or bend angle in the steering device 100.

As should be appreciated, the relative rotation between the middle section 120 and the lower section 130 controls the magnitude of a change in drilling direction relative to a long axis 13 of the wellbore. The relative rotation between the upper section 110 and the middle section 120, on the other hand, controls the direction for drilling.

In FIG. 1C, the drilling direction is shown in what may be considered a wellbore highside direction. This drilling direction may be changed or adjusted by rotating the middle section 120 relative to the upper section 110. Referring to FIG. 1C, the end faces 122 and 132 still have their direction of tilt aligned to maximize a tilt or bend angle caused in the steering device 100. However, the middle section 120 has been rotated one-hundred eighty degrees relative to the upper section 110. The drilling direction will still generally follow the axial centerline 106 to change the trajectory of the wellbore 12. However, the azimuthal drilling direction is now the wellbore lowside direction, or one hundred eighty degrees offset from the direction shown in FIG. 1B. It should be appreciated that the relative rotation between the upper section 110 and the middle section 120 may be set at any value between zero and three hundred sixty degrees to drill in a desired azimuthal direction.

The skilled artisan will realize that example steering device 100 can vary from that shown in FIGS. 1A-1B.

Figure 2:
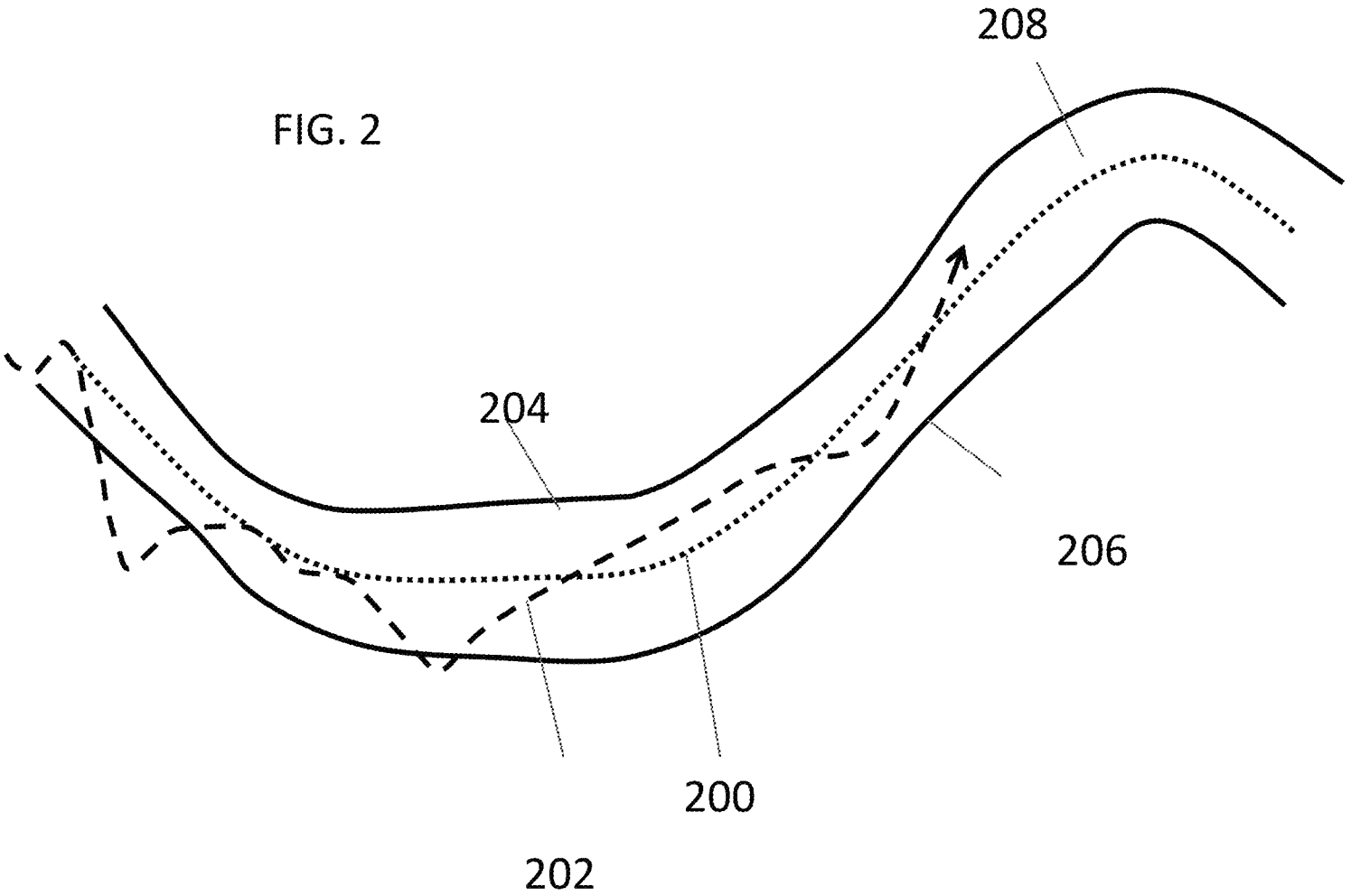
FIG. 2 shows a comparison of an actual and prescribed path relative to a pay zone.

FIG. 2 shows an example of a comparison of actual drilled path 200 as compared to a prescribed path 202. For clarity, the vertical scale of this figure is very much enlarged relative to the horizontal scale. The prescribed path 202 is generally centered between the top 204 and bottom 206 of the pay zone 208. The closer that the actual drilled path 200 it to the prescribed path 202 the more "centralized" the wellbore (e.g., drilled path 200) is within the pay zone 208. Centralizing a wellbore within a pay zone or keeping a prescribed distance from one of its boundaries maximizes oil production from it. A centralized well path may also be shorter making it quicker (and cheaper) to drill with less wear on bit, cuttings to remove, and fewer feet drilled. In practice, current horizontal wells may wander outside of the pay zone 50% of the time leading to 50% less production over the entire life of the well, which represents many, many millions of dollars. It shall be understood that the prescribed path may be formed based on a distance between the drill bit and formation properties. Thus, in one embodiment, not only are position of bit/drill string sensors provided but additional sensors that determine a distance to a formation are also provided.

Figure 3:
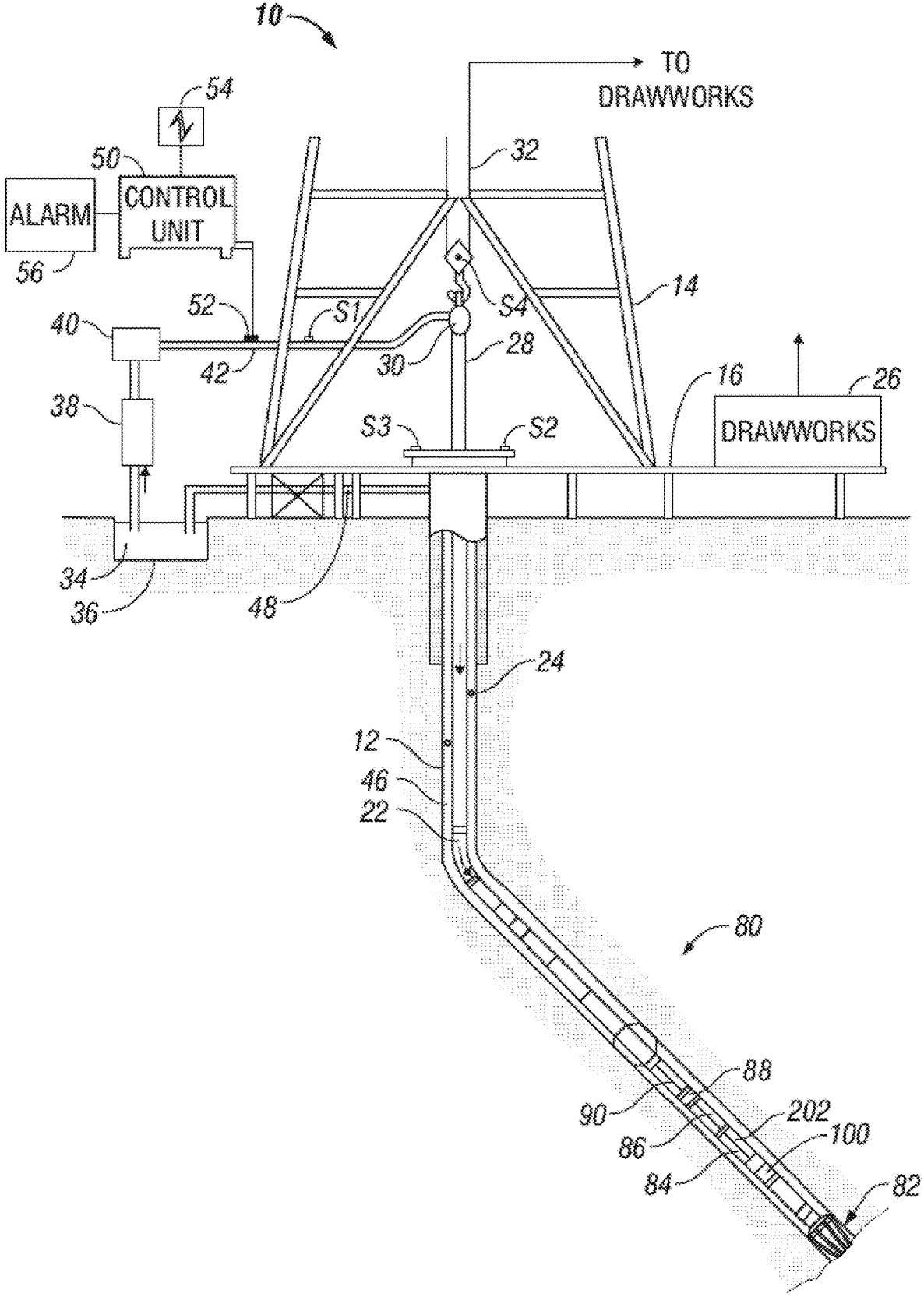
FIG. 3 schematically illustrates a drilling system using a steering device made in accordance with one embodiment of the present disclosure.

Referring now to FIG. 3, there is shown an embodiment of a drilling system 10 utilizing a steerable drilling assembly or bottomhole assembly (BHA) 80 made according to one embodiment of the present disclosure to directionally drill wellbores. While a land-based rig is shown, these concepts and the methods are equally applicable to offshore drilling systems. The system 10 shown in FIG. 3 has a drilling assembly 80 conveyed in a borehole 12. The drill string 22 includes a jointed tubular string 24, which may be drill pipe or coiled tubing, extending downward from a rig 14 into the borehole 12. The drill bit 82, attached to the drill string end, disintegrates the geological formations when it is rotated to drill the borehole 12. The drill string 22, which may be jointed tubulars or coiled tubing, may include power and/or data conductors such as wires for providing bi-directional communication and power transmission. The drill string 22 is coupled to a draw works 26 via a kelly joint 28, swivel 30 and line 32 through a pulley (not shown). The operation of the drawworks 26 is well known in the art and is thus not described in detail herein.

During drilling operations, a suitable drilling fluid 34 from a mud pit (source) 36 is circulated under pressure through a channel in the drill string 22 by a mud pump 34. The drilling fluid passes from the mud pump 38 into the drill string 22 via a desurger 40, fluid line 42 and Kelly joint 28. The drilling fluid 34 is discharged at the borehole bottom through an opening in the drill bit 82. The drilling fluid 34 circulates uphole through the annular space 46 between the drill string 22 and the borehole 12 and returns to the mud pit 36 via a return line 48. The drilling fluid acts to lubricate the drill bit 82 and to carry borehole cutting or chips away from the drill bit 82. A sensor $S_1$ typically placed in the line 42 provides information about the fluid flow rate. A surface torque sensor $S_2$ and a sensor $S_3$ associated with the drill string 22 respectively provide information about the torque and rotational speed of the drill string 22. Additionally, sensor $S_4$ associated with line 29 is used to provide the hook load of the drill string 22.

A surface controller 50 receives signals from the downhole sensors and devices via a sensor 52 placed in the fluid line 42 and signals from sensors $S_1$, $S_2$, $S_3$, hook load sensor $S_4$ and any other sensors used in the system and processes such signals according to programmed instructions provided to the surface controller 50. The surface controller 50 displays desired drilling parameters and other information on a display/monitor 54 and is utilized by an operator to control the drilling operations. The surface controller 50 is an optical computing device in one embodiment. The surface controller 50 processes data according to programmed instructions and responds to user commands entered through a suitable device, such as a keyboard or a touch screen. The controller 50 is preferably adapted to activate alarms 56 when certain unsafe or undesirable operating conditions occur and to cause the steering device to cause the well bore to follow a prescribed path. As illustrated, the surface controller is shown as being at the rig. Of course, it could be at another location.

Still referring to FIG. 3, the sensor sub 86 may include sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for making rotary directional surveys. The formation evaluation sub 90 may includes sensors for determining parameters of interest relating to the formation, borehole, geophysical characteristics, borehole fluids and boundary conditions. These sensor include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

The subs 86 and 90 may include one or memory modules, and a battery pack module to store and provide back-up electric power may be placed at any suitable location in the BHA 80. Additional modules and sensors may be provided depending upon the specific drilling requirements. Such exemplary sensors may include an rpm sensor, a weight on bit sensor, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry as generally known in the art. These sensors may be positioned in the subs 86 and 90, distributed along the drill pipe, in the drill bit and along the BHA 80. Further, while subs 86 and 90 are described as separate modules, in certain embodiments, the sensors above described may be consolidated into a single sub or separated into three or more subs. The term "sub" refers merely to any supporting housing or structure and is not intended to mean a particular tool or configuration.

Processor 202 processes the data collected by the sensor sub 86 and formation evaluation sub 90 and transmits appropriate control signals to the steering device 100 based on information it receives from the control unit 50. The processor 202 may be configured to decimate data, digitize data, and include suitable PLC's. For example, the processor may include one or more microprocessors that uses a computer program implemented on a suitable machine-readable medium that enables the processor to perform the control and processing. The machine-readable medium may include ROMs, EPROMs, EAROMs, Flash Memories and Optical disks. Other equipment such as power and data buses, power supplies, and the like will be apparent to one skilled in the art. The processor 202 may positioned in the sensor sub 86 or elsewhere in the BHA 80. Moreover, other electronics, such as electronics that drive or operate actuators for valves and other devices may also be positioned along the BHA 80.

The bidirectional data communication and power module ("BCPM") 88 transmits control signals between the BHA 80 and the surface as well as supplies electrical power to the BHA 80. For example, the BCPM 88 provides electrical power to the steering device 100 and establishes two-way data communication between the processor 202 and surface devices such as the controller 50. In one embodiment, the BCPM 88 generates power using a mud-driven alternator (not shown) and the data signals are generated by a mud pulser (not shown). The mud-driven power generation units (mud pursers) are known in the art and thus not described in greater detail. In addition to mud pulse telemetry, other suitable two-way communication links may use hard wires (e.g., electrical conductors, fiber optics), acoustic signals, EM or RF. Of course, if the drill string 22 includes data and/or power conductors (not shown), then power to the BHA 80 may be transmitted from the surface.

In one configuration, the BHA 80 includes a drill bit 82, a drilling motor 84, a sensor sub 86, a bidirectional communication and power module (BCPM) 88, and a formation evaluation (FE) sub 90. To enable power and/or data transfer to the other making up the BHA 80, the BHA 80 includes a power and/or data transmission line (not shown). The steering device 100 may be operated to steer the BHA 80 along a selected drilling direction by applying an appropriate tilt to the drill bit 82.

Referring now to FIGS. 1A-C and 3, in an exemplary manner of use, the BHA 80 is conveyed into the wellbore 12 from the rig 14. During drilling of the wellbore 12, the steering device 100 steers the drill bit 82 in a selected direction. The drilling direction may follow a preset trajectory that is programmed into a surface and/or downhole controller (e.g., controller 50 and/or controller 202). The controller(s) use directional data received from downhole directional sensors to determine the orientation of the BHA 80, compute course correction instructions if needed, and transmit those instructions to the steering device 100. This may be done by comparing a current location or trajectory to a prescribed path in one embodiment.

To initiate directional drilling, a drilling direction is first selected. This may be performed by first determining the directional information such as azimuth and inclination from the directional sensor on-board the BHA 80. The drilling direction may be selected by a downhole controller and/or by personnel at the surface. Thereafter, a downhole controller and/or personnel at the surface may determine the azimuthal orientation and the amount of tilt required to steer the drill string 22 in the selected direction. This may be done by comparing actual and proscribed paths after the actual path has been modeled by the control unit 50 which is an optical computing device in one embodiment. Then, in known manners, the steering unit may be controlled to cause the actual path to more closely follow the prescribed path.

Figure 4:
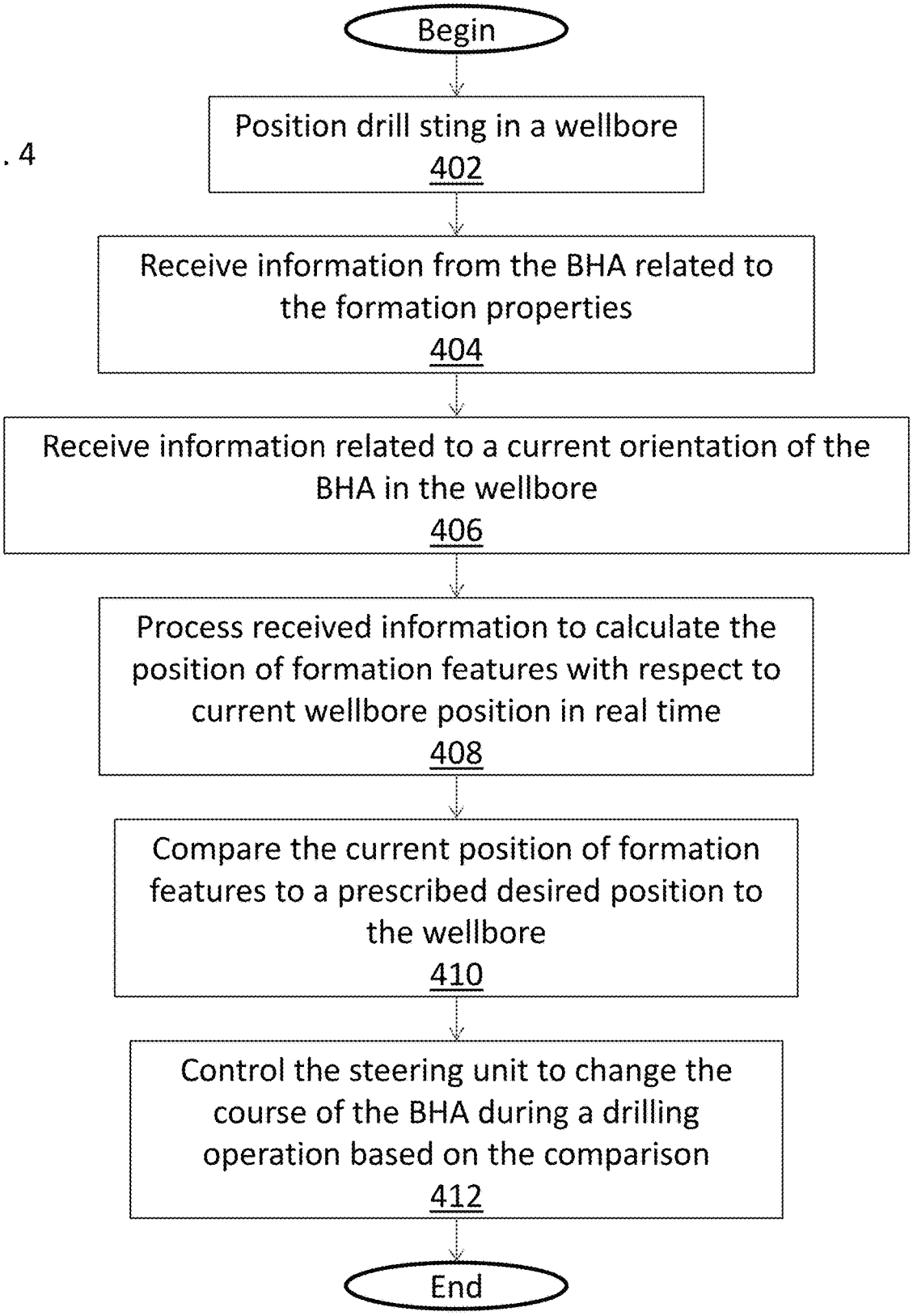
FIG. 4 is a flow chart of method according to one embodiment.

FIG. 4 is flow chart showing a method according to one embodiment. In this embodiment, the method includes block 402 where a drill string is positioned in a wellbore; The drill string may include a bottom hole assemble (BHA) that includes, a steering unit, one or more sensors responsive to one or more formation properties, and one or more sensors responsive to the current orientation of the BHA in a wellbore. Examples of the formation property sensors includes sensors that measure resistivity, dielectric constant, water saturation, porosity, density and permeability and examples of the orientation sensors include BHA azimuth and inclination sensors and BHA coordinate sensors.

At block 404, information is received from the BHA related to the formation properties. At block 406, information related to a current orientation of the BHA in the wellbore is received. The information received in blocks 404 and 406 may be received at a programmable optical computing device or a quantum computing device. At block 408, the received information is processed to calculate the position of formation features with respect to current wellbore position in real time. In the prior art, this was not possible as the time required to perform such a calculation (e.g., a 2D or 3D inversion) could not be done in real time. At block 410, the current position of formation features are compared to a prescribed desired position with to the wellbore and at block 412 the steering unit is controlled to change the course of the BHA during a drilling operation based on the comparison.

It shall be understood that in one embodiment the computing device is at a remote location. In such a case, the operator of a rig may send information from the drilling site to the computing device that performs the above calculations and then receives the inversion back and then causes the change in the steering device.

Embodiment 1, a method for forming a wellbore in an earth formation includes: positioning a drill string in a wellbore; the drill string including a bottom hole assemble (BHA) that includes a steering unit, one or more sensors responsive to one or more formation properties, and one or more sensors responsive to the current orientation of the BHA in a wellbore; receiving information from the BHA related to the formation properties and information related to a current orientation of the BHA in the wellbore; processing the information using a programmable optical computing device, the programmable optical computing device calculating the position of formation features with respect to current wellbore position in real time; comparing the current position to a prescribed path; and causing the steering unit to change a course of the BHA during a drilling operation based on the comparison.

Embodiment 2, the method of embodiment 1, wherein the causing includes transmitting a signal to the steering unit that causes the steering unit to move a steering pad.

Embodiment 3, the method of any prior embodiment, wherein the orientation information is received from sensors located on the BHA.

Embodiment 4, the method of any prior embodiment, wherein the orientation sensors include at least one of: a BHA azimuth sensor; a BHA inclination sensor; and a BHA coordinate sensor.

Embodiment 5, the method of any prior embodiment, wherein the formation information is received from sensors located on the BHA and the sensors include at least one formation evaluation sensor.

Embodiment 6, the method of any prior embodiment, wherein the optical computing device operates at a speed equal to or greater than 320 gigaflops.

Embodiment 7, a system of drilling a wellbore in an earth formation, comprising: a drill string including a bottom hole assemble (BHA) that includes a steering unit; a high speed computing device that is either a programmable optical computing device or a quantum computing device; a communication network coupling the BHA to the high speed computing device; wherein the high speed computing device, in operation, calculates current wellbore position with respect to formation features, using information received form the BHA and compares that position to a prescribed path and provides information that causes the steering unit to change a course of the BHA during a drilling operation based on the comparison.

Embodiment 8, the system of any prior embodiment wherein the causing includes transmitting a signal to the steering unit that causes the steering unit to move a steering pad.

Embodiment 9, the system of any prior embodiment, wherein the orientation information is received from sensors located on the BHA.

Embodiment 10, the system of any prior embodiment wherein the sensors include at least one of: a BHA azimuth sensor; a BHA inclination sensor; and a BHA coordinate sensor.

Embodiment 11, the system of any prior embodiment, wherein the sensors include at least one formation evaluation sensor.

Embodiment 12, a method for forming a wellbore in an earth formation, comprising: positioning a drill string including a bottom hole assemble (BHA) that includes a steering unit, one or more sensors responsive to one or more formation properties, and one or more sensors responsive to the current orientation of the BHA in a wellbore; receiving information from the BHA related to the formation properties and information related to a current orientation of the BHA in the wellbore at a quantum computing device; processing the information using a quantum computing device, the programmable optical computing device calculating the position of formation features with respect to current wellbore position in real time; comparing the current position to a prescribed path; and causing the steering unit to change a course of the BHA during a drilling operation based on the comparison.

Embodiment 13, the method of any prior embodiment, wherein the causing includes transmitting a signal to the steering unit that causes the steering unit to move a steering pad.

Embodiment 14, the method of any prior embodiment, wherein the orientation information is received from sensors located on the BHA.

Embodiment 15, the method of any prior embodiment, wherein the sensors include at least one of: a BHA azimuth sensor; a BHA inclination sensor; and a BHA coordinate sensor.

Embodiment 16, the method of any prior embodiment, wherein the position information is based on a distance to a pay zone and the sensors include at least one formation evaluation sensor.

In support of the teachings herein, various analysis components may be used, including digital and/or analog systems. The digital and/or analog systems may be included, for example, in the downhole electronics unit 42 or the processing unit 28. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs, USB flash drives, removable storage devices), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for forming a wellbore in an earth formation, comprising:

positioning a drill string in a wellbore; the drill string including a bottom hole assembly (BHA) that includes a steering unit, one or more sensors responsive to one or more formation properties, and one or more sensors responsive to the current orientation of the BHA in a wellbore;

receiving information from the BHA related to the formation properties and information related to a current orientation of the BHA in the wellbore;

performing at least a 2-dimensional model inversion of the information received from the BHA using a programmable optical computing device that utilizes photons produced by a laser to perform calculations, the programmable optical computing device calculating the position of formation features with respect to current wellbore position in real time;

comparing the current position to a prescribed path; and causing the steering unit to perform a geosteering operation and change a course of the BHA during a drilling operation based on the comparison.

2. The method of claim 1, wherein the causing includes transmitting a signal to the steering unit that causes the steering unit to move a steering pad.

3. The method of claim 1, wherein the orientation information is received from sensors located on the BHA.

4. The method of claim 3, wherein the orientation sensors include at least one of:

a BHA azimuth sensor; a BHA inclination sensor; and a BHA coordinate sensor.

5. The method of claim 3, wherein the formation information is received from sensors located on the BHA and the sensors include at least one formation evaluation sensor.

6. The method of claim 1, wherein the optical computing device operates at a speed equal to or greater than 320 gigaflops.

7. A system of drilling a wellbore in an earth formation, comprising:

a drill string including a bottom hole assemble (BHA) that includes a steering unit;

a high speed computing device that is a programmable optical computing device that utilizes photons to perform calculations; and a communication network coupling the BHA to the high speed computing device;

wherein the high speed computing device, in operation, performs at least a 2-dimensional model inversion using data received from the BHA and calculates current wellbore position with respect to formation features using the data received from the BHA and compares that position to a prescribed path and provides information that causes the steering unit to perform a geosteering operation and change a course of the BHA during a drilling operation based on the comparison, wherein the high speed computing device utilizes photons produced by a laser to perform the 2-dimensional model inversion.

8. The system of claim 7, wherein the causing includes transmitting a signal to the steering unit that causes the steering unit to move a steering pad.

9. The system of claim 7, wherein the orientation information is received from sensors located on the BHA.

10. The system of claim 9, wherein the sensors include at least one of:

a BHA azimuth sensor; a BHA inclination sensor; and a BHA coordinate sensor.

11. The system of claim 9, wherein the sensors include at least one formation evaluation sensor.

* * * * *